US005125666A

United States Patent [19]

Adams

[11] Patent Number: 5,125,666

[45] Date of Patent: Jun. 30, 1992

[54] FOUR-PLAYER CHESS

[76] Inventor: Timothy J. Adams, 130 SW. 142nd, Beaverton, Oreg. 97006

[21] Appl. No.: 738,172

[22] Filed: Jul. 30, 1991

[51] Int. Cl.[5] ..... A63F 3/02

[52] U.S. Cl. ..... 273/261

[58] Field of Search ..... 272/242, 260, 261

[56] References Cited

U.S. PATENT DOCUMENTS

| | | | |
|---|---|---|---|
| 511,773 | 1/1894 | Higgins | 273/261 |
| 694,509 | 3/1902 | Winckfield | 273/261 |
| 1,134,922 | 4/1915 | Smith | 273/261 |
| 3,101,587 | 8/1963 | Patrick | 273/260 X |
| 3,843,130 | 10/1974 | Whitney | 273/261 |
| 4,037,843 | 7/1977 | Hoffman | 273/261 |
| 4,067,578 | 1/1978 | Chang | 273/261 |
| 4,708,349 | 11/1987 | Shomer | 273/261 |
| 4,778,187 | 10/1988 | Deak | 273/261 |
| 4,932,669 | 6/1990 | Perry | 273/261 |

FOREIGN PATENT DOCUMENTS

| | | | |
|---|---|---|---|
| 642970 | 9/1928 | France | 273/261 |
| 241021 | 2/1946 | Switzerland | 273/261 |
| 1030519 | 5/1966 | United Kingdom | 273/261 |

*Primary Examiner*—William H. Grieb
*Assistant Examiner*—William E. Stoll
*Attorney, Agent, or Firm*—Kolisch, Hartwell, Dickinson, McCormack & Heuser

[57] ABSTRACT

The invented four-player chess game includes a plurality of distinguishable sets of playing pieces including pieces equivalent to pawns, rooks, knights, bishops, queens and kings. It also includes a board having a main playing area made from a square matrix of eight-by-eight alternately colored playing spaces with two additional rows of eight alternately colored playing spaces adjacent each side of the main playing area. The game is played by placing each player's set of playing pieces on the game board so that each different set occupies two rows adjacent one side of the main playing area in a conventional chess arrangements. Each player moves, in turn, one of his playing pieces anywhere on the game board according to standard chess rules, except the pieces equivalent to pawns may move up to three spaces forward on each of those pieces' initial move. Playing pieces are captured according to standard chess rules, except the pieces equivalent to pawns initially located at the ends of the first additional rows of alternately colored playing spaces adjacent the main playing area may not move diagonally to capture another piece equivalent to a pawn that has not moved. When more than two players are playing and remain in the game, players are eliminated when their king is captured and actually removed from the board, at which time all the remaining playing pieces in the set of the removed king are taken off the board. Play continues until only two players remain, at which time the game ends when one player checkmates the other player's king or when neither player can checkmate the other player's king.

8 Claims, 2 Drawing Sheets

FOUR-PLAYER CHESS

TECHNICAL FIELD

This invention relates to the game of chess. More particularly, it relates to a chess game playable by two, three or four persons.

BACKGROUND ART

Chess is a game of skill for two players. It is played on a square board divided into 64 squares arranged in an eight-by-eight matrix, or in eight rows of eight squares each. The rows of squares are called ranks. Columns of squares are called files. The squares are alternately light and dark. Each row has four light and four dark squares, with a light square at one end and a dark square at the other end. Each player has 16 pieces, a king, a queen, two bishops, two knights, two rooks or castles and eight pawns to move in different ways on the board. The game progresses by capturing and removing pieces from the board during alternate moves until one player checkmates his opponent's king (moves so that an opponent's king cannot be protected or moved to safety) or until neither can do so and a stalemate results.

The two players sit across from each other with the board between them. The board is positioned so that the row of light and dark squares closest to each player ends with a light square on each player's right side. The chess pieces are arranged on the two horizontal rows of light and dark squares closest to each player. In chess, the two player's pieces are typically white (or light) and black (or dark), corresponding to the light and dark squares on the board. Each player's queen is placed on the row closest to the player on the light or dark square nearest the center of the row, depending on whether the queen is light or dark. If the queen is light, it is placed on the light square. If the queen is dark, it is placed on the dark square. In other words, the queen is placed on the square of her own color. The king is placed next to the queen on the other square nearest the center of the same row. One bishop is placed on the square next to the queen and the other bishop is placed on the square next to the king. The knights are placed next to the bishops, one on each square next to each bishop and the rooks are placed on the squares at the ends of the row. Eight pawns are placed on the eight squares of the row immediately adjacent the row on which the king and queen are positioned, one pawn per square.

Each playing piece moves in a predetermined way. The king can move one square in any direction. The king can capture other pieces by moving into the square occupied by the other piece. However, the king cannot move into danger, or into a square where the king could be captured by another piece.

The queen moves in a straight line on the rank, the file or diagonally in any direction and for any distance over unoccupied squares. The queen cannot jump over pieces. The queen captures a piece by moving into the square occupied by that piece.

The bishop moves diagonally in any direction over unoccupied squares. Thus, one bishop may only move on dark squares and the other bishop may only move on light squares. The bishop captures by moving into a square occupied by another piece.

The knights move either one square in any direction and then two squares to the right or left, or two squares in any direction and then one square to the right or left. Thus, the movement is all "L" shaped. The knight captures by moving into any square occupied by another piece.

The rooks move in a straight line on the rank or file over any number of unoccupied squares. The rooks cannot move diagonally. The rooks capture by moving into a square occupied by another piece.

Each pawn only moves one square forward per move except for each pawn's initial move when it can move one or two squares forward. Each pawn can only capture a piece on one of the two squares that are diagonally adjacent to the square on which the pawn rests. In other words, the pawn captures by moving into a diagonally adjacent square occupied by another piece. The pawn can only move into a diagonally adjacent square to capture another piece. If a pawn moves to the eighth rank, or the rank at the opposite side of the board, then the pawn is exchanged for a queen, rook, bishop or knight of the same color without regard to the number and type of pieces already on the board.

Each player can perform a move called a "castle" once in the game. That move involves a player's king and one rook. The move consists of placing the king two squares to its right or left and placing the rook toward which the king moved on the square on the other side of the king. However, a player cannot castle if the king is in check, if there are other pieces between the king and rook, if the king or rook have been previously moved, or if the king or rook must pass over or land on a square occupied by an opponent's piece.

A king is "checked" when he is attacked by an opponent's piece. The player "checking" an opponent's king must say "check". When a king is checked, the king must either move out of check, the attacking piece must be captured, or another piece must be moved between the king and the attacking piece. If none of those things can be done, then the king is "checkmated" and the game is over.

Traditional chess is very popular because it requires strategy. However, chess is limited to two players. Additionally, chess is often slow-moving and lengthy.

The invented game discussed in this document, on the other hand, allows two, three or four players to play chess. It is also a fast paced, less lengthy game. The invented game also requires more strategy than traditional chess because three or four players can create unique offensive and defensive scenarios.

SUMMARY OF THE INVENTION

The invented four-player chess game includes a plurality of distinguishable sets of playing pieces including pieces equivalent to pawns, rooks, knights, bishops, queens and kings. The game is played on a board having a main playing area made from a square matrix of eight-by-eight alternately colored playing spaces with two additional rows of eight alternately colored playing spaces adjacent each side of the main playing area. The game is played by placing each player's set of playing pieces on the game board so that each different set occupies two rows adjacent one side of the main playing area in a conventional chess arrangement. Each player moves, in turn, one of his playing pieces anywhere on the game board according to standard chess rules, except the pieces equivalent to pawns may move up to three spaces forward on each of those pieces' initial move. Playing pieces are captured according to standard chess rules, except the pieces equivalent to pawns initially located at the ends of the first additional rows of alternately colored playing spaces adjacent the main playing area may not move diagonally to capture another piece equivalent to a pawn that has not moved. When more than two players are playing and remain in the game, players are eliminated when their king is captured and actually removed from the board, at which time all the remaining playing pieces in the set of the removed king are taken off the board. Play continues until only two players remain, at which time the game ends when one player checkmates the other player's king or when neither player can checkmate the other player's king.

DETAILED DESCRIPTION AND BEST MODE FOR CARRYING OUT THE INVENTION

Figure 1:
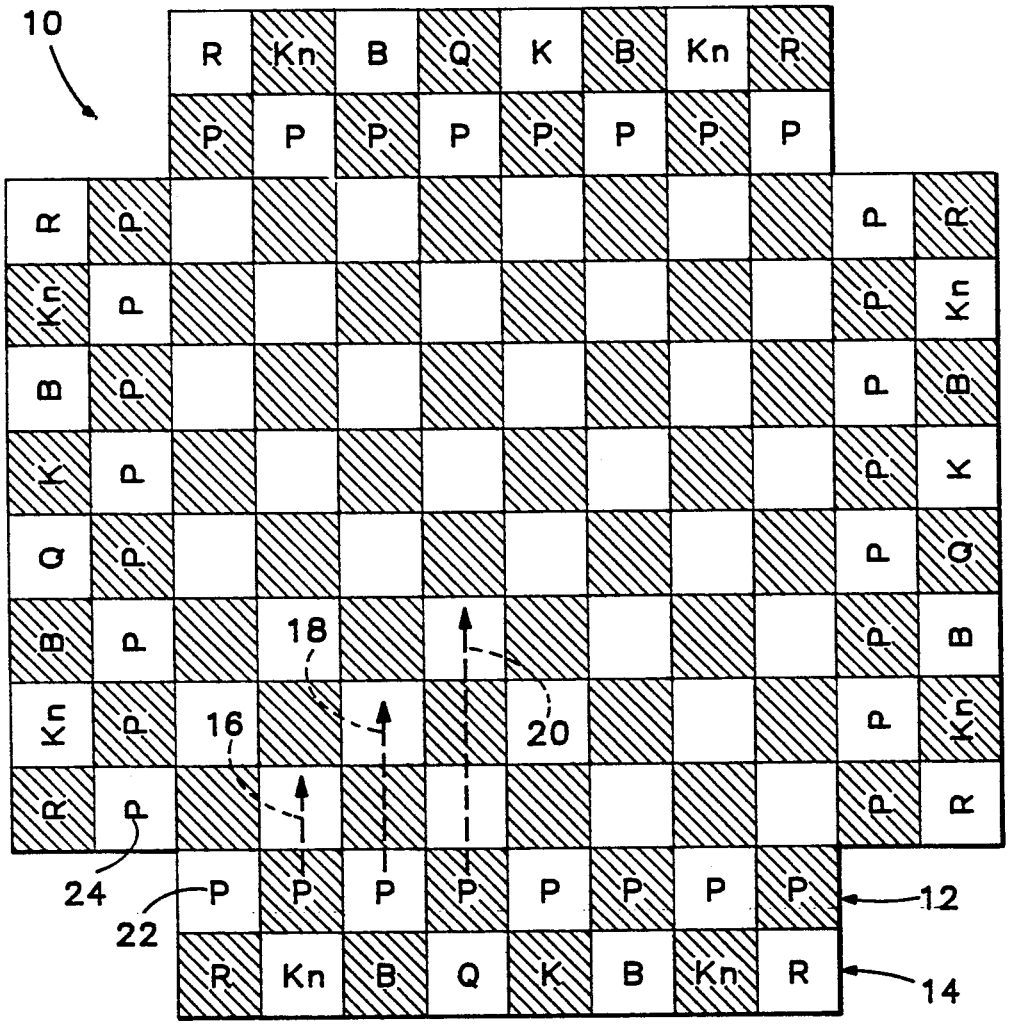
FIG. 1 is a plan view of the invented chess board with letters indicating the placement of the playing pieces.

Applicant's chess game is played on a game board as shown at 10 in FIG. 1. The board has a main playing area defined by a square matrix of eight-by-eight alternately colored playing spaces. Two additional rows of eight alternately colored playing spaces are adjacent each side of the main playing area, such as rows 12 and 14 in FIG. 1.

The game may be played by two, three or four players. Each player has a distinguishable set of playing pieces. Each set includes pieces equivalent to pawns (identified by the letter "P" in FIGS. 1 & 2), rooks (identified by the letter "R" in FIGS. 1 & 2), knights (identified by the letters "Kn" in FIGS. 1 & 2), bishops (identified by the letter "B" in FIGS. 1 & 2), queens (identified by the letter Q in FIGS. 1 & 2) and kings (identified by the letter "K" in FIGS. 1 and 2). Those playing pieces may look like standard chess pieces or they may look like tanks, foot soldiers, airplanes, generals, etc., or any other appearance. Typically each set is distinguishable from the other sets by color. For example, one set of playing pieces may be white, another black, one red and another blue. Other colors may also be used or a marking may be placed on each character.

The players are arranged on the game board as shown in FIG. 1 when three or four players play the game. Specifically, the board is positioned so that each player is adjacent one side of the board. Two players will have a light colored square on the right end of the row of alternately colored squares closest to them. The other two players will have a dark square on their right. Each player's king and queen are placed on the center two spaces of the row closest to the player. The queens and kings of different sets of playing pieces should be positioned directly opposite each other as shown in FIG. 1. In standard two-player chess, the queen is positioned on the square of her color. For example, a white queen is placed on a light square and a black queen is placed on a dark square. However, in four-player chess, the colors of the playing pieces may vary and therefore the queens and kings are only placed directly opposite each other. Two of the queens, nonetheless, can be placed on their own colors, or if two queens are light and two queens are dark, they can all be placed on squares of their own color.

There are two rows of eight alternately colored playing spaces adjacent each side of the main playing area in order to allow the pieces to move into the main playing area quickly, while allowing enough space to accommodate a plurality of players. Only one row of eight alternately colored playing spaces would be insufficient to accommodate a plurality of players.

In the invented game, each player moves, in turn, one of his playing pieces anywhere on the game board according to standard chess rules, except that each pawn may initially move one, two or three spaces forward, as shown in FIG. 1 by dashed lines 16, 18 and 20. After its initial move, each pawn moves as in standard chess. The pawns only move forward or, if capturing, diagonally and cannot change directions. All pieces can move both in the main playing area and in the adjacent extra rows. The players can select whether a pawn can be exchanged for another playing piece when it reaches the opposite edge of the main playing area or when it reaches the second of the two adjacent rows.

Typically, the player's decide who moves first. The play continues in a clockwise direction from player to player.

During a move, one player may capture another player's playing pieces according to standard chess rules. However, the pawns initially located at the ends of the first additional rows of alternately colored playing spaces adjacent the main playing area may not move diagonally to capture another pawn that has not moved. For example, pawn 22 in FIG. 1 may not move diagonally to capture pawn 24. If a different pawn or other playing piece occupied the square of pawn 24, then pawn 22 could move diagonally to capture that piece.

Players are eliminated from the game when a player's king is captured. If more than two players are playing and remain in the game, another player's king must be captured and actually removed from the playing board. For example, a king may be checked or checkmated on one move, but that player can only be eliminated if, on another move, the king is actually captured and removed from the board. In standard chess, the king is never actually removed from the board. Therefore, "checkmate" does not actually happen until only two players remain in the game.

When a king is captured and removed from the board, all the remaining playing pieces associated with the king are taken off the board. The requirement to capture and remove kings from the board adds a new dimension to the game because when a king is captured and its associated playing pieces are removed, different vulnerabilities or paths of attack may be created which were not seen by the person capturing the king. Removing the king's associated pieces may place the capturing king in jeopardy by opening an attack path for a bishop, queen or other piece. Thus, before a king is removed from the board a player must consider what will happen when the king's associated pieces are removed.

Play continues by moving and capturing pieces and by eliminating players until only two players remain. At that time, the game ends when one player checkmates the other player's king or when neither player can checkmate the other player's king.

If two or three players are playing and another player wants to enter the game, the first two or three players can decide whether to allow the additional player to enter. The additional player can begin with a full set of pieces or he can be handicapped by requiring him to play without a queen or other piece.

Additionally, players can form alliances among themselves and "gang-up" on other players. Thus, "check"

and "checkmate" do not have the same effect when three or four players are playing because another player may intervene and prevent the capture of a king.

The invented four-player chess can be played with a timer that allows a predetermined amount of time for each move. When the timer is used, a player must move a playing piece within the predetermined amount of time. The players can agree that failure to move a playing piece within the time requires the player to sacrifice one of his playing pieces of his choice or the playing piece of least significance. Alternatively, the players can begin using the timer at any point after the game has started to increase the game's speed.

Another variation when using a timer allows a player to move a playing piece within the predetermined amount of time plus any time remaining from the previous player's predetermined amount of time if the previous player moved a piece within his predetermined amount of time. That variation ensures that each player will have a set amount of time to consider his move even if the previous player moved immediately.

The invented game may also be played with the requirement that a player who checks another player's king must say "check" or that player is prohibited from capturing the king. If the player does not say "check" he would be prohibited from actually capturing the king on his next move.

Figure 2:
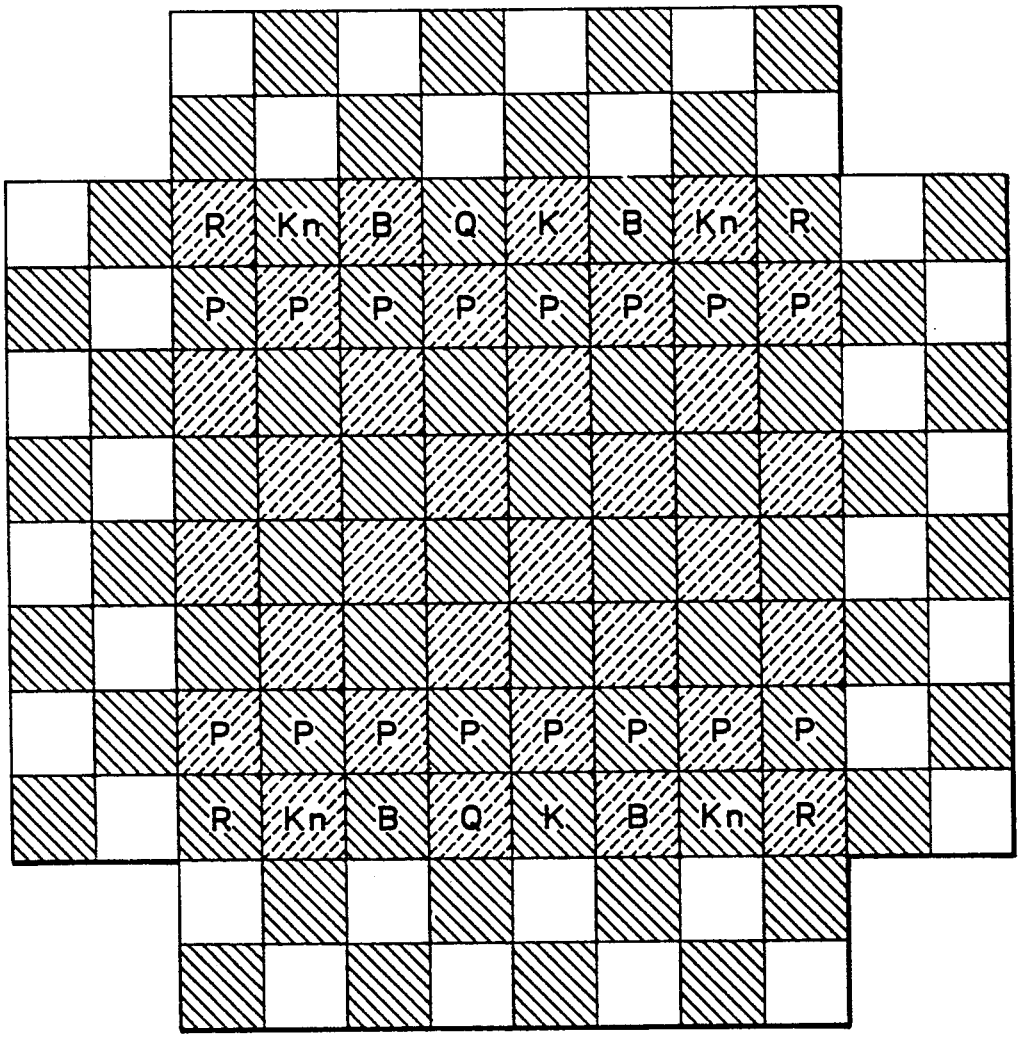
FIG. 2 is a plan view of the invented chess board where the main playing area is distinguishable from the adjacent side rows.

Two-player chess can also be played on the invented game board by using the main playing area only. To facilitate two-player chess, the main playing area can be shaded darker or lighter than the additional rows so that it is distinguishable, as shown in FIG. 2.

The invented four-player chess can also be implemented in a video game, arcade game or any other computer-based system having a visual display. It is particularly applicable to network games where several people play against each other over a computer network or phone lines.

When applied to a video, computer or arcade game, the invented method would be embodied in software, firmware and/or hardware. Any software code capable of implementing the movement and capturing restrictions of the invented game can be used. Additionally, the display of a video, computer or arcade game may present the gameboard in a two-dimensional image or a three-dimensional image.

INDUSTRIAL APPLICABILITY

The invented four-player chess is applicable to the toy and game industry. It is also applicable to the video and computer game industry. It is particularly attractive to chess players and chess clubs. It provides a fun, fast-paced futuristic game that requires a more three dimensional strategy than standard chess. Moreover, more people can enjoy the game by playing together or more skilled players can challenge two or three players. Additionally, teams can play against each other.

While a preferred embodiment of the invention has been described, changes may be made without departing the from the spirit of the invention.

I claim:

1. A method of playing chess by a plurality of players, each player having a distinguishable set of playing pieces including pieces equivalent to pawns, rooks, knights, bishops, a queen and a king, played on a game board having a main playing area comprising a square matrix of eight by eight alternately colored playing spaces with two additional rows of eight alternately colored playing spaces adjacent each side of the main playing area, the method comprising:

placing each player's set of playing pieces on the game board so that each different set occupies two rows adjacent one side of the main playing area in a conventional chess arrangement;

each player moving, in turn, one of his playing pieces anywhere on the game board according to standard chess rules, except the pieces equivalent to pawns may move one, two or three spaces forward on each of those piece's initial move;

capturing, during moving, other player's playing pieces according to standard chess rules, except the pieces equivalent to pawns initially located at the ends of the first additional rows of alternately colored playing spaces adjacent the main playing area may not move diagonally to capture another piece equivalent to a pawn that has not moved;

when more than two players are playing and remain in the game, eliminating players from the game, by capturing and removing a player's piece equivalent to a king, at which time all the remaining playing pieces in the set of the removed king are taken off the board; and continuing the steps of moving, capturing and eliminating until only two players remain, at which time the game ends when one player checkmates the other player's piece that is equivalent to a king or when neither player can checkmate the other player's piece that is equivalent to a king.

2. The method of claim 1 played with a timer that allows a predetermined amount of time for each move.

3. The method of claim 2 where a player must move a playing piece within the predetermined amount of time, and where failure to move a playing piece within the time requires that player to sacrifice one of his playing pieces.

4. The method of claim 2 where the timer is first used after the game has started.

5. The method of claim 2 where a player moves a playing piece within the predetermined amount of time, further comprising allowing the next player to move a playing piece within the same predetermined amount of time plus the time remaining from the previous player's predetermined amount of time.

6. The method of claim 1 where a player who "checks" another player's piece equivalent to a king must say "check" or that player is prohibited from capturing the piece equivalent to a king on his next move.

7. The method of claim 1 where the playing pieces are conventional chess playing pieces.

8. The method of claim 1 where the players determine who moves first and where play continues in a clockwise direction around the game board.

* * * * *